US007878239B2

(12) United States Patent
Koh et al.

(10) Patent No.: US 7,878,239 B2
(45) Date of Patent: Feb. 1, 2011

(54) FLUID COLLECTING APPARATUS

(75) Inventors: Yong Kwon Koh, Daejeon (KR); Kyung Woo Park, Daejeon (KR); Si Won Yoo, Seoul (KR); Jong Won Choi, Daejeon (KR)

(73) Assignees: Korea Atomic Energy Research Institute, Daejeon (KR); Korea Hydro & Nuclear Power Co., Ltd., Seoul (KR)

( * ) Notice: Subject to any disclaimer, the term of this patent is extended or adjusted under 35 U.S.C. 154(b) by 135 days.

(21) Appl. No.: 12/323,949

(22) Filed: Nov. 26, 2008

(65) Prior Publication Data

US 2010/0126713 A1 May 27, 2010

(51) Int. Cl.
*E21B 33/124* (2006.01)

(52) U.S. Cl. ..... 166/191; 166/185; 166/180; 166/387

(58) Field of Classification Search ..... 166/191, 166/185, 186, 187, 180, 179, 387, 385, 241.5, 166/264; 277/331, 333
See application file for complete search history.

(56) References Cited

U.S. PATENT DOCUMENTS

| | | | | |
|---|---|---|---|---|
| 1,549,168 | A * | 8/1925 | Townsend | 277/331 |
| 2,629,446 | A * | 2/1953 | Freling et al. | 277/333 |
| 2,979,134 | A * | 4/1961 | Reed et al. | 166/67 |
| 3,393,744 | A * | 7/1968 | Fagg et al. | 166/187 |
| 4,268,043 | A * | 5/1981 | Forssell | 277/333 |
| 4,508,172 | A * | 4/1985 | Mims et al. | 166/303 |
| 4,776,396 | A * | 10/1988 | Studholme | 166/187 |
| 6,286,603 | B1 * | 9/2001 | Parent | 166/387 |
| 6,761,062 | B2 | 7/2004 | Shapiro | |
| 6,834,727 | B2 * | 12/2004 | Wills et al. | 166/387 |
| 2008/0053652 | A1 * | 3/2008 | Corre et al. | 166/179 |

FOREIGN PATENT DOCUMENTS

| | | |
|---|---|---|
| JP | 06-002713 | 1/1994 |
| JP | 07-091165 | 4/1995 |
| JP | 08-035979 | 2/1996 |
| JP | 09-025783 | 1/1997 |
| KR | 10-0299417 | 6/2001 |
| KR | 20-0321675 | 7/2003 |

* cited by examiner

*Primary Examiner*—Kenneth Thompson
(74) *Attorney, Agent, or Firm*—Sunstein Kann Murphy & Timbers LLP

(57) ABSTRACT

A fluid collecting apparatus inserted in a borehole for collecting fluid in the borehole. The fluid collecting apparatus may include a first packer and a second packer which are selectively adhered to an inside of the borehole, a first supply pipe and a second supply pipe which supply expansion fluid to each of the first packer and the second packer, and a guide tube which guides fluid in a collecting space between the first packer and the second packer to an outside of the borehole. Also, the second supply pipe moves with the second packer in a longitudinal direction of the borehole, and a passage which does not communicate with the first supply pipe is formed. Accordingly, the fluid collecting apparatus may independently control the first and second packers, and thus fluid in a desired depth and region within the borehole may be easily collected.

16 Claims, 7 Drawing Sheets

FLUID COLLECTING APPARATUS

BACKGROUND

1. Field of the Invention

The present invention relates to a fluid collecting apparatus, and more particularly, to a fluid collecting apparatus which may easily collect fluid from a desired depth and region within a borehole, and thereby may reduce a time and effort to collect the fluid.

2. Description of the Related Art

In general, a hydraulic test and geochemical analysis have been conducted to examine hydraulic characteristics of a borehole in a medium such as a crystalline rock. A groundwater collecting apparatus has been used to collect groundwater sample for the test and analysis.

A general groundwater collecting apparatus in a conventional art is described with reference to FIGS. 1 and 2. FIG. 1 is a cross-sectional view illustrating a groundwater collecting apparatus in a conventional art. FIG. 2 is a cross-sectional view illustrating the groundwater collecting apparatus of FIG. 1 where expanded packers are adhered to an inside of a borehole.

In the conventional art, the groundwater collecting apparatus may include an upper packer 10 and a lower packer 30, supply pipes 20 and 40, a coupling pipe 60, and a guide tube 50. The supply pipes 20 and 40 may supply expansion fluid to the upper packer 10 and the lower packer 30, and thereby provide pressure to the upper packer 10 and the lower packer 30. The coupling pipe 60 may couple the upper packer 10 and the lower packer 30. The guide tube 50 may guide groundwater (W) in a collecting space between the upper packer 10 and the lower packer 30 to an outside of a borehole (H).

As illustrated in FIG. 2, a pair of packers, the upper packer 10 and the lower packer 30, may be provided with the fluid through the supply pipes 20 and 40, and expanded. Accordingly, the upper packer 10 and the lower packer 30 may be adhered to an inside of the borehole (H), and an area between the upper packer 10 and the lower packer 30 in the borehole (H) may be hydraulically isolated.

Also, the supply pipes 20 and 40 may include the upper supply pipe 20 and the lower supply pipe 40. The upper supply pipe 20 may supply the expansion fluid to the upper packer 10, and the lower supply pipe 40 may supply the expansion fluid to the lower packer 30. The lower supply pipe 40 communicates with the upper supply pipe 20.

Accordingly, when the expansion fluid is provided to the upper packer 10 through the upper supply pipe 20, the expansion fluid may be provided to the lower supply pipe 40 communicated with the upper supply pipe 20. Thus, the expansion fluid may be provided to the lower packer 30. That is, the upper packer 10 and the lower packer 30 may be relatively simultaneously expanded and adhered to the inside of the borehole (H) by supplying the expansion fluid to the upper supply pipe 20.

Also, an inlet hole 62 may be formed in the coupling pipe 60. The inlet hole 62 may collect the groundwater (W) in a collecting space isolated by the upper packer 10 and the lower packer 30. A plurality of segments is combined in the coupling pipe 60, and may maintain a gap between the upper packer 10 and the lower packer 30. The coupling pipe 60 may couple the upper packer 10 and the lower packer 30. Accordingly, the groundwater (W) in a desired depth and region within the borehole (H) may be collected by adjusting a number of segments of the coupling pipe 60.

In order to adjust a depth and region in the conventional art, however, the groundwater collecting apparatus inserted in the borehole (H) is required to be lifted up to the ground, the number of segments to be adjusted, a length of the coupling pipe 60 to be adjusted, and the groundwater collecting apparatus to be again inserted in the borehole (H). Accordingly, a great amount of time and effort are spent.

Also, since the upper packer 10 and the lower packer 30 are simultaneously expanded and shrunken, the groundwater (W) may be collected in a particular area. Also, the upper packer 10 and the lower packer 30 may not function as a single packer to collect groundwater above a particular water level and groundwater below a particular water level.

Also, as the coupling pipe 60 includes the plurality of segments and the length of the coupling pipe 60 may be adjusted based on the number of segments, only a limited number of possible gaps between the upper packer 10 and the lower packer 30 may be available.

SUMMARY

An aspect of the present invention provides a fluid collecting apparatus which may easily change a depth and region within a borehole.

Another aspect of the present invention also provides a fluid collecting apparatus which may easily change a depth and region while within a borehole in the ground, and thereby may significantly reduce a time and effort to collect fluid.

Another aspect of the present invention also provides a fluid collecting apparatus which may hydraulically isolate groundwater in a borehole in a single direction, and thereby may function as a single packer.

Another aspect of the present invention also provides a fluid collecting apparatus which continuously adjust a depth and region within a borehole, and thereby may variously change the depth and region.

According to an aspect of the present invention, there is provided a fluid collecting apparatus inserted in a borehole for collecting fluid in the borehole, the fluid collecting apparatus including: a first packer which is selectively adhered to an inside of the borehole; a first supply pipe which communicates with the first packer and supplies expansion fluid to an inside of the first packer; a second packer which is spaced apart from the first packer, and is selectively adhered to the inside of the borehole; a second supply pipe which communicates with the second packer, supplies the expansion fluid to an inside of the second packer, and moves with the second packer in a longitudinal direction of the borehole; and a guide tube which communicates with a collecting space between the first packer and the second packer, and is extended to an outside of the borehole to guide fluid in the collecting space to the outside of the borehole. The first packer may be arranged above the second packer.

The second supply pipe may pass through the first packer, and a passage which does not communicate with the first supply pipe may be formed in the second supply pipe.

The second supply pipe may be mounted in the guide tube. The packer coupling pipe formed in the longitudinal direction of the borehole may be mounted on the first packer, and provide a space for the second supply pipe. The packer coupling pipe may be coupled to the guide tube.

A sealing coupling unit may be mounted between the packer coupling pipe and the guide tube. The sealing coupling unit may couple the packer coupling pipe and the guide tube in a sealed state.

The fluid collecting apparatus may further include a supporting member. The supporting member may be coupled to the second packer, pass through the first packer, and run along the second packer in the longitudinal direction of the borehole. The supporting member may be in a shape of a wire.

The supporting member may be mounted in the guide tube, or mounted outside of the guide tube and pass through the first packer.

Additional aspects, features, and/or advantages of the invention will be set forth in part in the description which follows and, in part, will be apparent from the description, or may be learned by practice of the invention.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
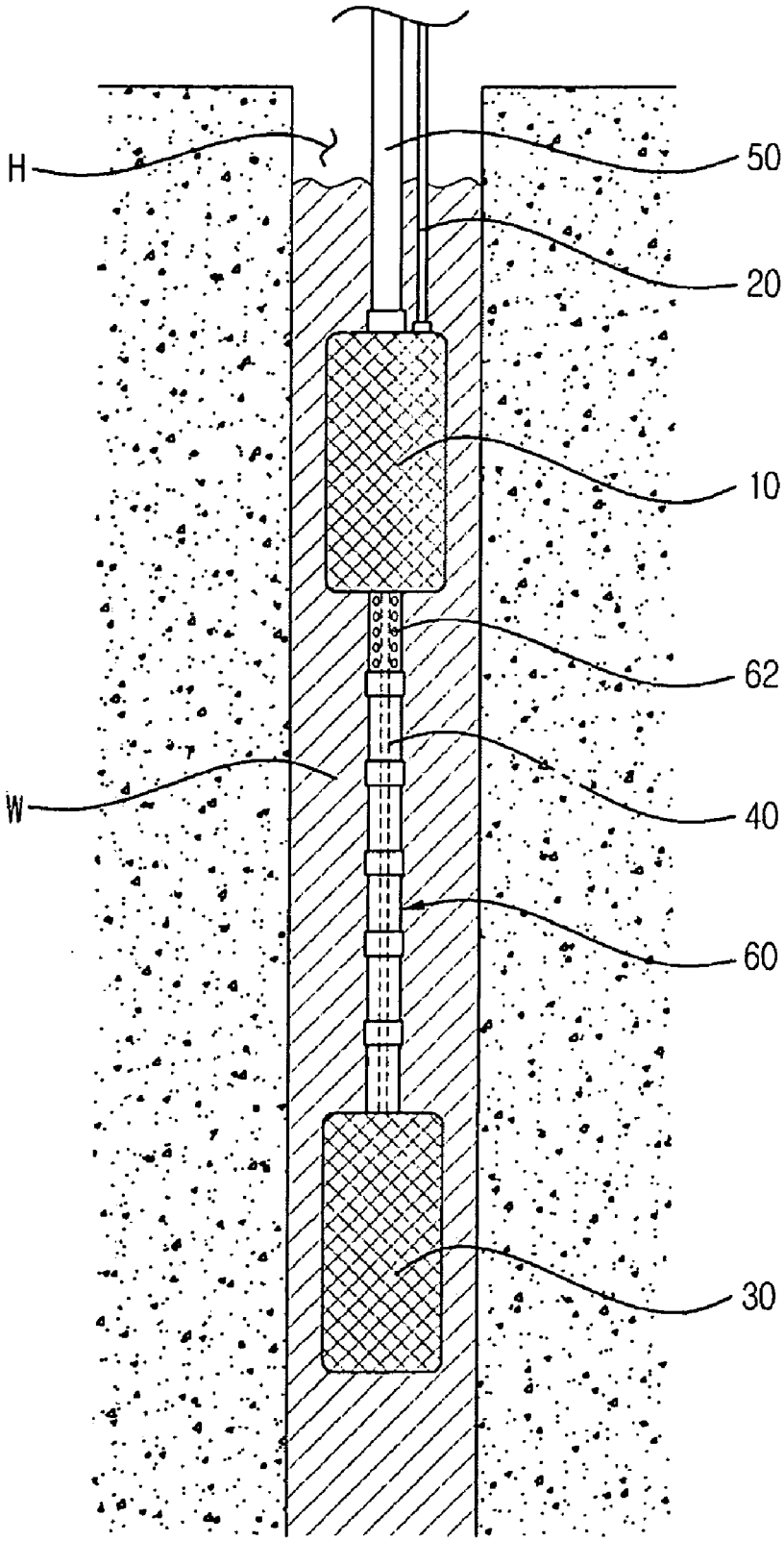
FIG. 1 is a cross-sectional view illustrating a groundwater collecting apparatus in a conventional art.
Figure 2:
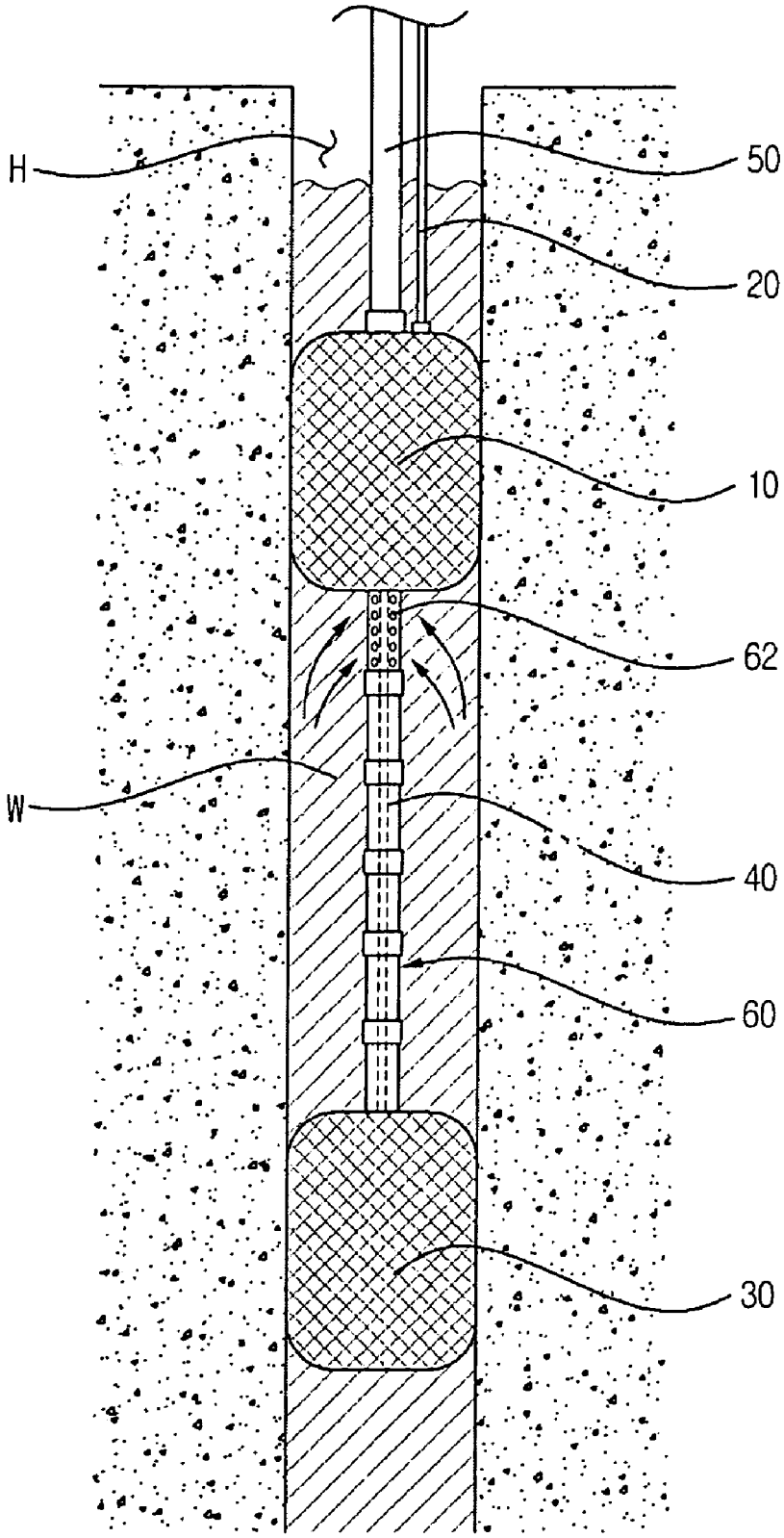
FIG. 2 is a cross-sectional view illustrating the groundwater collecting apparatus of FIG. 1 where expanded packers are adhered to an inside of a borehole.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Figure 3:
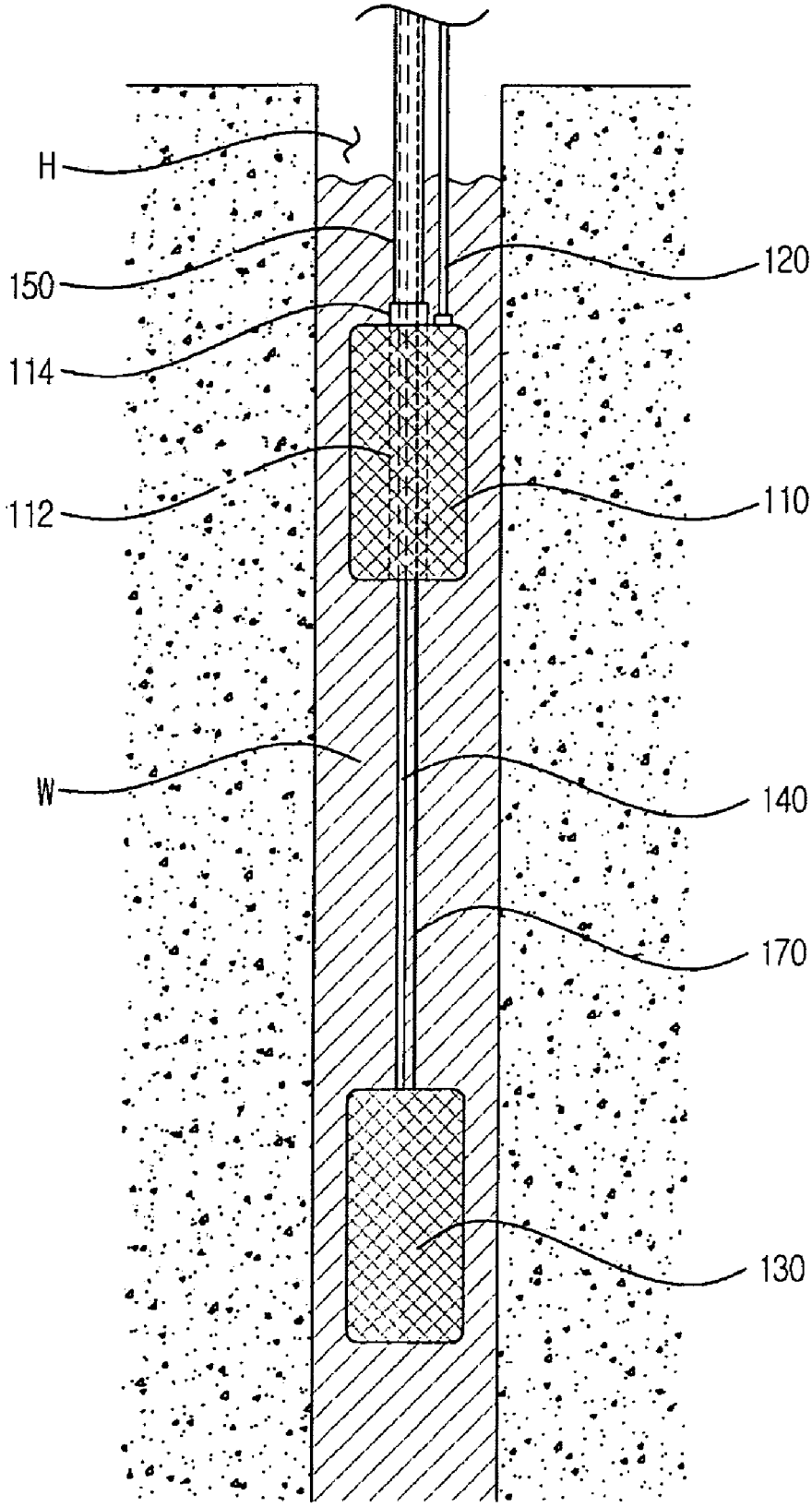
FIG. 3 is a cross-sectional view illustrating a fluid collecting apparatus according to an embodiment of the present invention.
Figure 4:
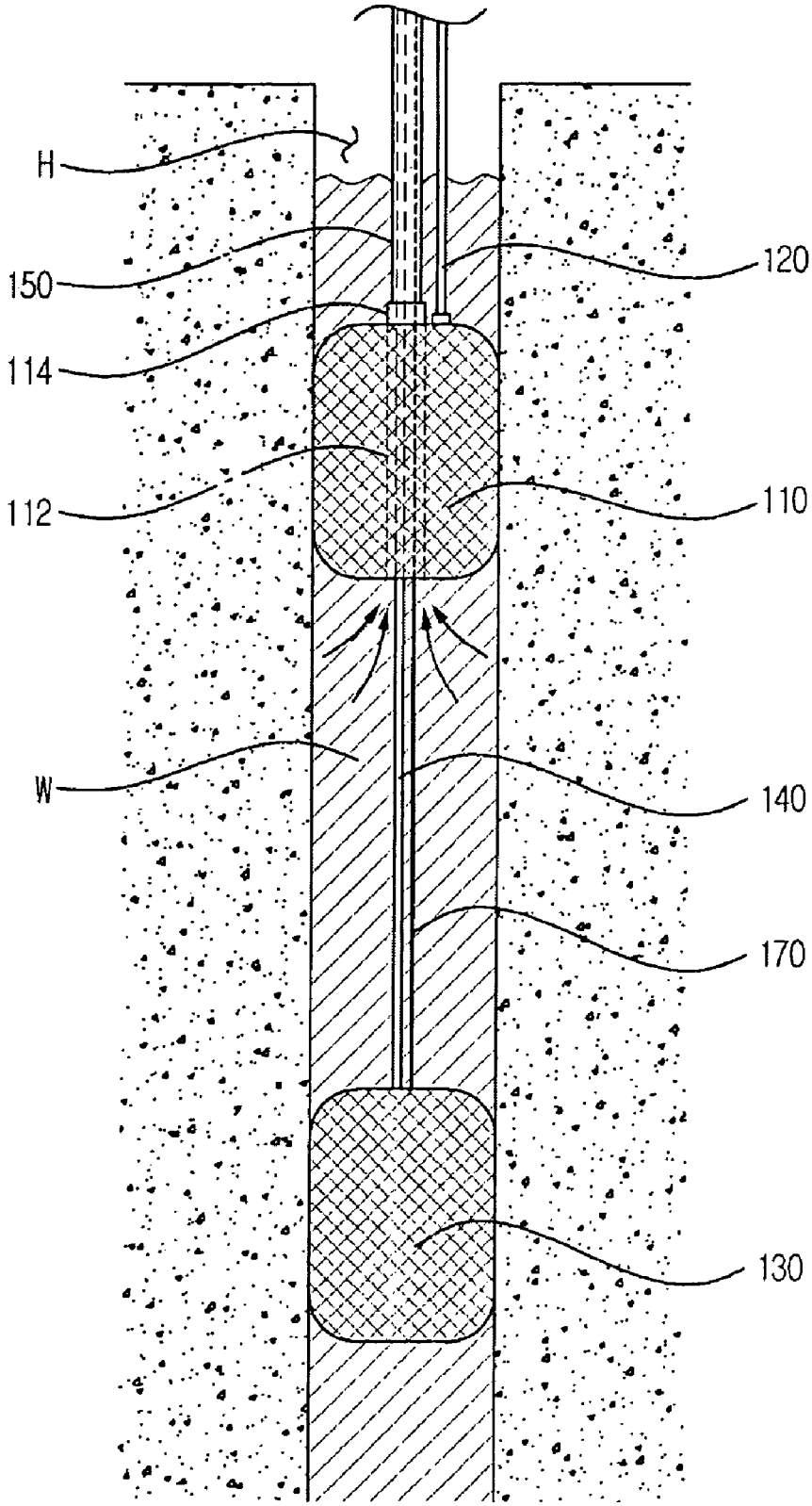
FIG. 4 is a cross-sectional view illustrating the fluid collecting apparatus of FIG. 3 where expanded packers are adhered to an inside of a borehole.

Referring to FIGS. 3 and 4, a fluid collecting apparatus according to an embodiment of the present invention is described in detail. FIG. 3 is a cross-sectional view illustrating a fluid collecting apparatus before a first packer 110 and a second packer 130 are expanded according to an embodiment of the present invention. FIG. 4 is a cross-sectional view illustrating expanded first and second packers 110 and 130 are adhered to an inside of a borehole in the fluid collecting apparatus of FIG. 3.

The fluid collecting apparatus may be inserted in a borehole (H) for collecting fluid in the borehole (H). The fluid collecting apparatus may include the first packer 110, a first supply pipe 120, the second packer 130, a second supply pipe 140, and a guide tube 150.

Here, fluid to be collected by the fluid collecting apparatus may vary. Hereinafter, groundwater (W) in the borehole (H) is described as an example.

The first packer 110 may be provided with expansion fluid, and thereby be selectively adhered to the inside of the borehole (H).

Also, the first supply pipe 120 may provide the expansion fluid to the first packer 110, and thereby may enable the first packer 110 to be expanded.

The second packer 130 may be spaced apart from the first packer 110 by a predetermined distance. Also, similar to the first packer 110, the second packer 130 may be provided with the expansion fluid, and be expanded and thereby selectively adhered to the inside of the borehole (H). The second packer 130 may be provided with the expansion fluid through the second supply pipe 140.

According to an embodiment of the present invention, the first packer 110 may be arranged above the second packer 130.

In this instance, unlike a conventional art, the first supply pipe 120 and the second supply pipe 140 may not communicate with each other. Also, a separate passage may be formed. That is, the first supply pipe 120 and the second supply pipe 140 may have passages independent from each other, and thus expansion degree of the first supply pipe 120 and the second supply pipe 140 may be independently adjusted.

The guide tube 150 may communicate with a collecting space hydraulically isolated due to the expansion of the first packer 110 and the second packer 130. Also, the guide tube 150 may be extended to an outside of the borehole (H) to guide the fluid in the collecting space to the outside of the borehole (H).

According to an embodiment of the present invention, a packer coupling pipe 112 may be coupled to the guide tube 150. The packer coupling pipe 112 may be formed in a longitudinal direction of the borehole (H), and be mounted in the first packer 110.

Accordingly, the groundwater (W) in the collecting space may be flowed into the packer coupling pipe 112 through a hole formed in a lower part of the packer coupling pipe 112. Also, the flowed groundwater (W) may flow into the guide tube 150 via the packer coupling pipe 112.

According to an embodiment of the present invention, a sealing coupling unit 114 may be mounted between the packer coupling pipe 112 and the guide tube 150. The sealing coupling unit 114 may couple the packer coupling pipe 112 and the guide tube 150 in a sealed state. Accordingly, the groundwater (W) in the collecting space may be flowed to the outside of the borehole (H) through the packer coupling pipe 112 and the guide tube 150 without water leakage.

According to an embodiment of the present invention, as illustrated in FIGS. 3 and 4, the second supply pipe 140 may be mounted in the guide tube 150.

The fluid collecting apparatus may include a supporting member 170. The supporting member 170 may be coupled to the second packer 130, pass through the first packer 110, and run along the second packer 130 in the longitudinal direction of the borehole (H).

A shape of the supporting member 170 may not be limited. However, the supporting member 170 may have sufficient tensile strength to lift up the second packer 130. For example, the supporting member 170 may be in a shape of a wire with a particular strength.

When the second supply pipe 140 has sufficient strength to manage resistance due to the lifting of the second packer 130, the supporting member 170 may not be required. However, according to an embodiment of the present invention, the second supply pipe 140 may have minimum strength and the supporting member 170 may support the second supply pipe 140 to handle the resistance. Accordingly, the strength of the second supply pipe 140 is not required to be separately increased.

Although it is not illustrated in FIGS. 3 and 4, a pump for generating suction power may be included in the fluid collecting apparatus to pump the fluid in the collecting space to the outside of the borehole (H).

An operation of a fluid collecting apparatus according to an embodiment of the present invention is described in detail with reference to FIGS. 5A and 5B.

As described above, a first supply pipe 120 and a second supply pipe 140 may have passages independent from each other, and provide expansion fluid to a first packer 110 and a second packer 130.

Figure 5A:
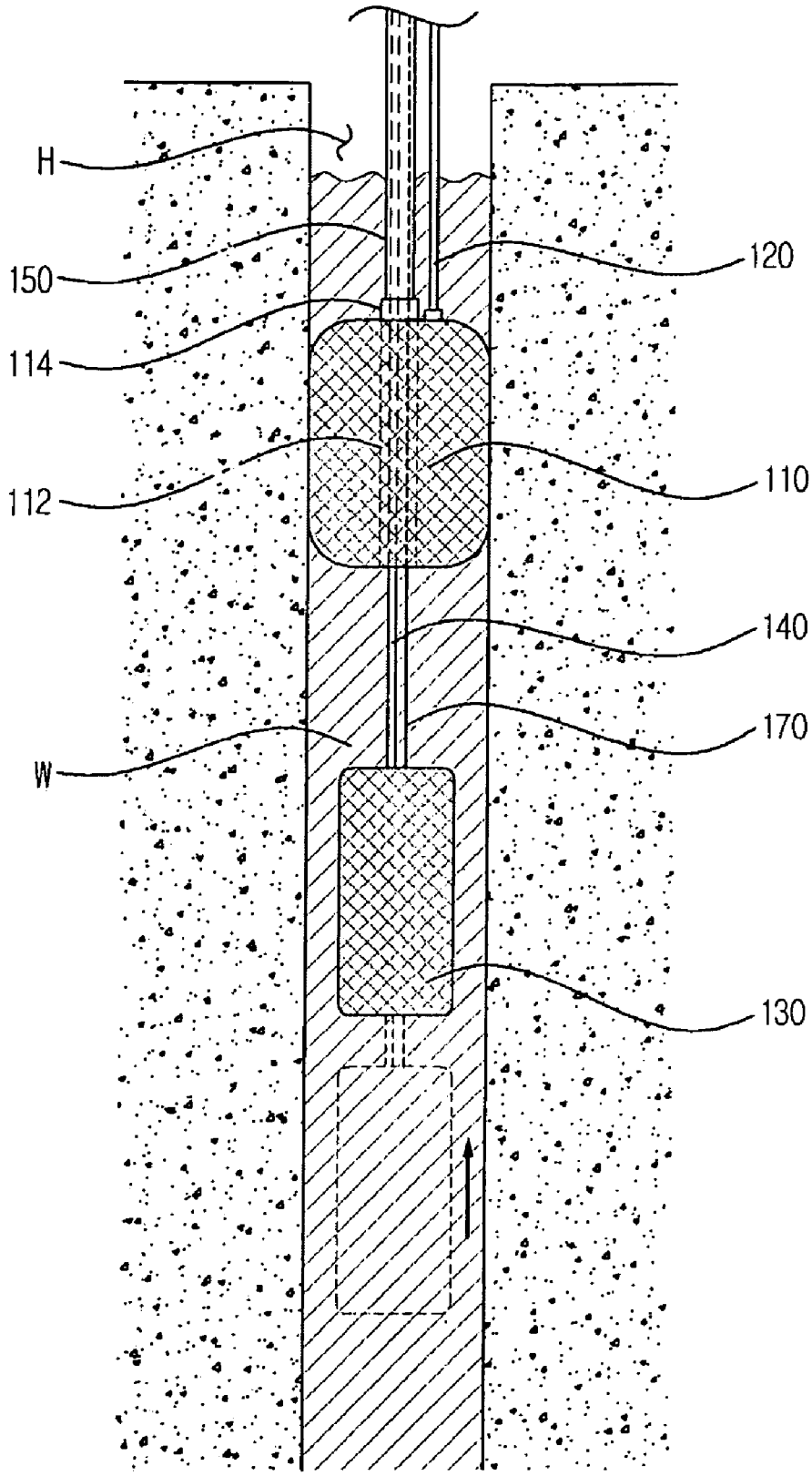
FIGS. 5A and 5B are cross-sectional views illustrating operations of moving a packer to adjust a collecting area.

Accordingly, when the fluid collecting apparatus is inserted in a borehole (H), a gap between the first packer 110 and the second packer 130 may be adjusted by moving the second packer 130 when the first packer 110 is adhered to an inside of the borehole (H) as illustrated in FIG. 5A.

In this instance, a supporting member 170 and the second supply pipe 140 may be lifted up to move the second packer 130. The supporting member 170 may be coupled to the second packer 130 and extended to an outside of the borehole (H).

Conversely, in order to move down the second packer 130, tension of the supporting member 170 and the second supply pipe 140 may be released and the second packer 130 may be lifted down due to an unladened weight of the second packer 130.

Also, the expansion fluid in the second packer 130 may be discharged through the second supply pipe 140 to smoothly move the second packer 130.

Figure 5B:
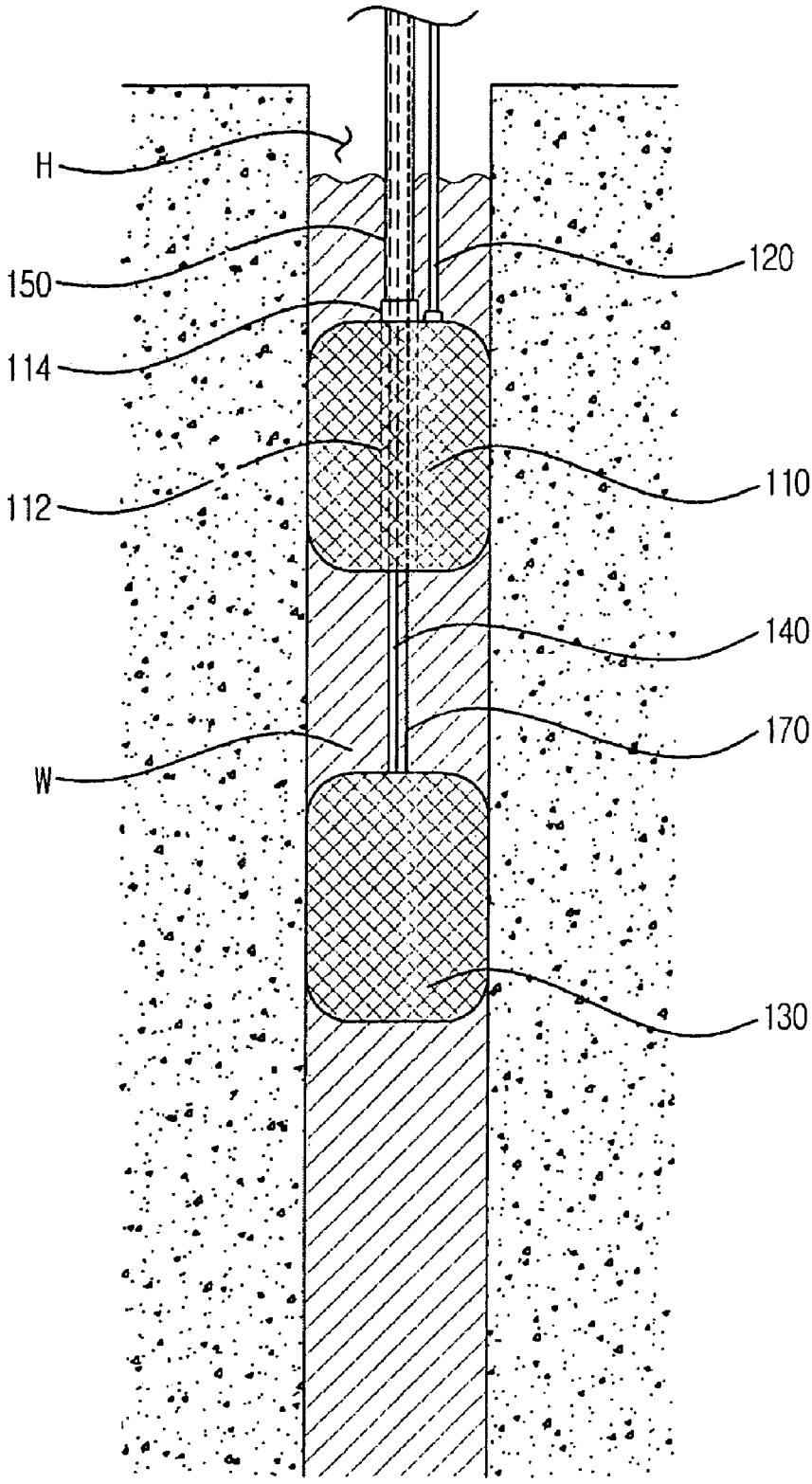

As described above, after the second packer 130 is moved to a desired location, the expansion fluid may be supplied to the second packer 130 through the second supply pipe 140, and thus the second packer 130 may be adhered to the inside of the borehole (H), as illustrated in FIG. 5B.

As described above, according to an embodiment of the present invention, a location of the second packer 130 may be freely determined by moving the supporting member 170 and the second supply pipe 140 from above ground when the fluid collecting apparatus is inserted in the inside of the borehole (H), without lifting up a fluid collecting apparatus to the ground to adjust a gap between packers as in a conventional art.

Also, expansion of the second packer 130 may be controlled independently from the first packer 110, and thus groundwater (W) in the borehole (H) may be hydraulically isolated in only one direction and the second packer 130 may function as a single packer.

Figure 6:
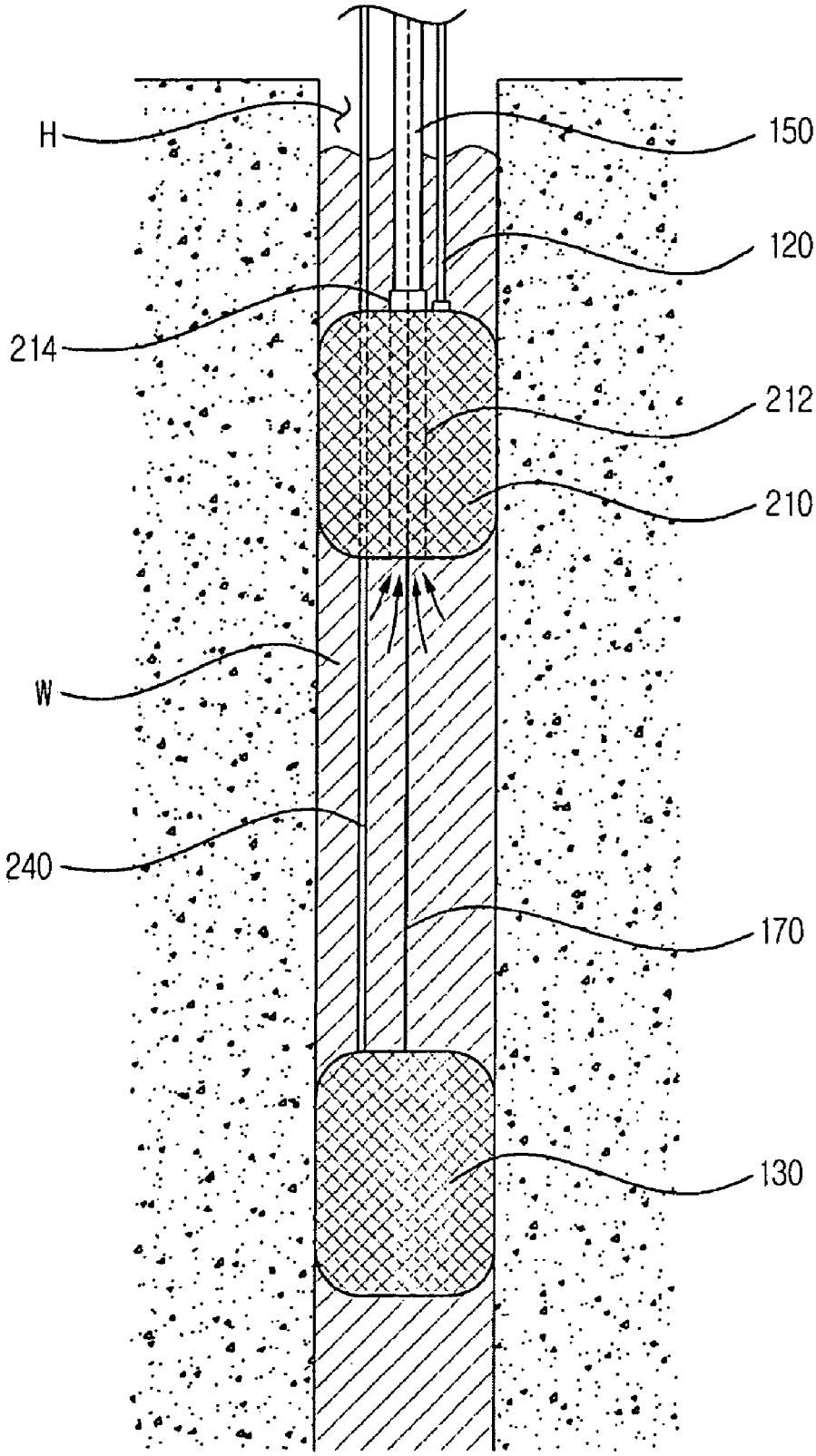
FIG. 6 is a cross-sectional view illustrating a fluid collecting apparatus according to another embodiment of the present invention.

A fluid collecting apparatus according to another embodiment of the present invention is described with reference to FIG. 6.

Similar to a fluid collecting apparatus according to an embodiment of the present invention, the fluid collecting apparatus according another embodiment of the present invention may include a first packer 210, first supply pipe 120, second packer 130, second supply pipe 240, and guide tube 150. Also, the first supply pipe 120 and the second supply pipe 240 may not communicate with each other and have passages independent from each other. Accordingly, expansion of the first packer 210 and the second packer 130 may be independently controlled.

However, as opposed to the fluid collecting apparatus according to an embodiment of the present invention, the second supply pipe 240 may not be included in the guide tube 150, and formed outside of the guide tube 150. Also, the second supply pipe 240 may communicate with the second packer 130, pass through the first packer 210, and be extended to a ground.

In this instance, the second supply pipe 240 may not communicate with the first packer 210 to prevent expansion fluid of the first packer 210 from flowing out. Also, the second supply pipe 240 may move separately from the first packer 210. Specifically, when both the second supply pipe 240 and the first packer 210 move, a gap between the second supply pipe 240 and the first packer 210 may change.

According to the above-described embodiments, the fluid collecting apparatus may adjust a gap between a first packer and a second packer as inserted in a borehole, and thereby may reduce a time and effort to adjust a depth and region within the borehole.

That is, a second supply pipe may move up and down, and thus a location of the second packer coupled to the second supply pipe may be freely determined. Accordingly, the gap between the first packer and the second packer may be easily adjusted.

Thus, a hydraulic test may be performed and groundwater may be collected in a desired depth and region within the borehole.

In particular, a supporting member to vertically move the second packer may be included, and thus the gap between the first packer and the second packer may be easily adjusted.

Also, according to the above-described embodiments, the fluid collecting apparatus may include passages independent from each other, in the first supply pipe and the second supply pipe supplying expansion fluid to the first packer and the second packer, and thereby may independently adjust expansion of the first packer and the second packer. Accordingly, groundwater in the borehole may be hydraulically isolated in only one direction, and each of the first and second packers may function as a single packer.

Thus, groundwater above a predetermined water level and groundwater below a predetermined water level may be selectively collected in the borehole, and a variety of hydraulic tests may be performed.

Also, according to the above-described embodiments, the fluid collecting apparatus may continuously adjust the gap between the first packer and the second packer by moving the second supply pipe, without adjusting the gap between the first and second packers using a plurality of segments in a conventional art. Accordingly, a depth and region within the borehole may variously change.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A fluid collecting apparatus inserted in a borehole for collecting fluid in the borehole, the fluid collecting apparatus comprising:

a first packer which is selectively adhered to an inside of the borehole;

a first supply pipe forming a passage which communicates with the first packer and supplies expansion fluid to an inside of the first packer;

a second packer which is spaced apart from the first packer, and is selectively adhered independently of the first packer to the inside of the borehole;

a second supply pipe forming a passage which communicates with the second packer and which does not communicate with the passage formed in the first supply pipe, supplies the expansion fluid to an inside of the second packer, and moves with the second packer in a longitudinal direction of the borehole;

a guide tube which communicates with a collecting space between the first packer and the second packer, and is extended to an outside of the borehole to guide fluid in the collecting space to the outside of the borehole; and a supporting member coupled to the second packer so as to permit adjustment of the longitudinal position of the second packer relative to the first packer while in the borehole.

2. The fluid collecting apparatus of claim 1, wherein the first packer is arranged above the second packer.

3. The fluid collecting apparatus of claim 1, wherein the second supply pipe passes through the first packer.

4. The fluid collecting apparatus of claim 1, wherein the second supply pipe is mounted in the guide tube.

5. The fluid collecting apparatus of claim 1, wherein a packer coupling pipe formed in the longitudinal direction of the borehole is mounted in the first packer, and provides a space for the second supply pipe, the packer coupling pipe being coupled to the guide tube.

6. The fluid collecting apparatus of claim 5, wherein a sealing coupling unit is mounted between the packer coupling pipe and the guide tube, the sealing coupling unit coupling the packer coupling pipe and the guide tube in a sealed state.

7. The fluid collecting apparatus of claim 1, wherein the supporting member runs along the fluid collecting apparatus in the longitudinal direction of the borehole so that lifting of the supporting member outside of the borehole can raise the second packer within the borehole up closer to the first packer.

8. The fluid collecting apparatus of claim 1, wherein the supporting member is in a shape of a wire.

9. The fluid collecting apparatus of claim 1, wherein the supporting member is mounted in the guide tube.

10. The fluid collecting apparatus of claim 1, wherein the supporting member is mounted outside of the guide tube and passes through the first packer.

11. A fluid collecting apparatus inserted in a borehole for collecting fluid in the borehole, the fluid collecting apparatus comprising:

a first packer which is selectively adhered to an inside of the borehole;

a first supply pipe which communicates with the first packer and supplies expansion fluid to an inside of the first packer;

a second packer which is spaced apart from the first packer, and is selectively adhered to the inside of the borehole;

a second supply pipe which communicates with the second packer supplies the expansion fluid to an inside of the second packer, and moves with the second packer in a longitudinal direction of the borehole;

a guide tube which communicates with a collecting space between the first packer and the second packer, and is extended to an outside of the borehole to guide fluid in the collecting space to the outside of the borehole; and wherein a packer coupling pipe formed in the longitudinal direction of the borehole is mounted in the first packer, and provides a space for the second supply pipe, the packer coupling pipe being coupled to the guide tube.

12. The fluid collecting apparatus of claim 11, wherein a sealing coupling unit is mounted between the packer coupling pipe and the guide tube, the sealing coupling unit coupling the packer coupling pipe and the guide tube in a sealed state.

13. A fluid collecting apparatus inserted in a borehole for collecting fluid in the borehole, the fluid collecting apparatus comprising:

a first packer which is selectively adhered to an inside of the borehole;

a first supply pipe which communicates with the first packer and supplies expansion fluid to an inside of the first packer;

a second packer which is spaced apart from the first packer, and is selectively adhered to the inside of the borehole;

a second supply pipe which communicates with the second packer supplies the expansion fluid to an inside of the second packer, and moves with the second packer in a longitudinal direction of the borehole;

a guide tube which communicates with a collecting space between the first packer and the second packer, and is extended to an outside of the borehole to guide fluid in the collecting space to the outside of the borehole; and a supporting member which is coupled to the second packer, passes through the first packer, and runs along the second packer in the longitudinal direction of the borehole.

14. The fluid collecting apparatus of claim 13, wherein the supporting member is in a shape of a wire.

15. The fluid collecting apparatus of claim 13, wherein the supporting member is mounted in the guide tube.

16. The fluid collecting apparatus of claim 13, wherein the supporting member is mounted outside of the guide tube and passes through the first packer.

* * * * *